United States Patent [19]

Hofmann et al.

[11] 4,133,321

[45] Jan. 9, 1979

[54] CLAMPING DEVICE FOR FUEL INJECTION NOZZLES

[75] Inventors: Karl Hofmann, Aldingen; Walter Mladek, Stuttgart, both of Germany

[73] Assignee: Robert Bosch GmbH, Stuttgart, Germany

[21] Appl. No.: 802,098

[22] Filed: May 31, 1977

Related U.S. Application Data

[63] Continuation of Ser. No. 423,761, Dec. 11, 1973, abandoned.

[30] Foreign Application Priority Data

Dec. 21, 1972 [DE] Fed. Rep. of Germany ..... 2262570

[51] Int. Cl.[2] ..... F02M 39/00

[52] U.S. Cl. ..... 123/32 R; 123/139 AW

[58] Field of Search ..... 123/32 JV, 32 R, 139 AW; 239/533.1–533.15, 600, 584

[56] References Cited

U.S. PATENT DOCUMENTS

| | | | |
|---|---|---|---|
| 1,515,496 | 11/1924 | Laeubli | 123/32 R |
| 2,148,505 | 2/1939 | Rosen | 123/32 R |
| 2,639,193 | 5/1953 | Wood, Jr. | 239/584 X |
| 3,035,559 | 5/1962 | Brandes et al. | 123/32 R |

FOREIGN PATENT DOCUMENTS

| | | | |
|---|---|---|---|
| 2109727 | 9/1972 | Fed. Rep. of Germany | 123/32 JV |

*Primary Examiner*—Charles J. Myhre
*Assistant Examiner*—Tony M. Argenbright
*Attorney, Agent, or Firm*—Edwin E. Greigg

[57] ABSTRACT

A clamping device in the form of a bracket for use in clamping a fuel injection nozzle to the cylinder head of an internal combustion engine. The clamping device has a generally flat top portion and a pair of legs extending therefrom which together define a U-shaped cross-sectional profile. The top portion includes a slot for receiving a portion of the injection nozzle while the free ends of the legs bear against flat portions of the injection nozzle.

3 Claims, 3 Drawing Figures

CLAMPING DEVICE FOR FUEL INJECTION NOZZLES

This is a continuation of application Ser. No. 423,761 filed Dec. 11, 1973 now abandoned.

BACKGROUND OF THE INVENTION

The present invention relates to a clamping device in the form of a bracket for fuel injection nozzles having an aperture for receiving an injection nozzle and designed to bear down on shoulders of the injection nozzle that are, preferably, formed by flat regions of the nozzle. The device is fastened, especially by bolts, to the internal combustion engine.

Known clamping devices for this purpose consist of a single forged or hot-pressed part which has the disadvantage of being relatively expensive to manufacture because such clamping devices must be able to withstand high bending loads.

OBJECTS AND SUMMARY OF THE INVENTION

It is, therefore, a general object of the present invention to develop a clamping device which, while having the same durability and elasticity of the known clamping devices, is nevertheless substantially cheaper to produce, requiring, if possible, only ordinary commercial materials and only a few simple production steps.

It is a more specific object of the present invention to provide a clamping device having a shaped profile including a pair of leg portions which bear against respective flattened portions of the injection nozzle which is being clamped to the cylinder block of an internal combustion engine.

These and other objects are achieved according to the present invention by the provision of a clamping device fabricated so as to have a substantially U-shaped cross-sectional profile whose legs bear on the shoulders of the injection nozzle.

In contrast to the known clamping devices, stamping out the slot and the openings in the device according to the present invention is very simple and therefore cost-saving. This makes it possible to use a basic type of U-profile for widely different types of nozzles, merely by selecting different slots and openings.

According to an advantageous embodiment of the present invention, the surfaces formed by the free legs of the device include a bent-over offset region and are nearest to one another in the area where they bear on the shoulders of the injection nozzle. In general, however, the surfaces of the legs are parallel to one another. Because of the offset, for the same thickness, the metal has a greater stability against buckling during high bending loads, especially in the region of the slot. An exemplary embodiment of the object of the invention is shown in the drawing and is further described below. cl

DESCRIPTION OF THE PREFERRED EMBODIMENT

Figure 1:
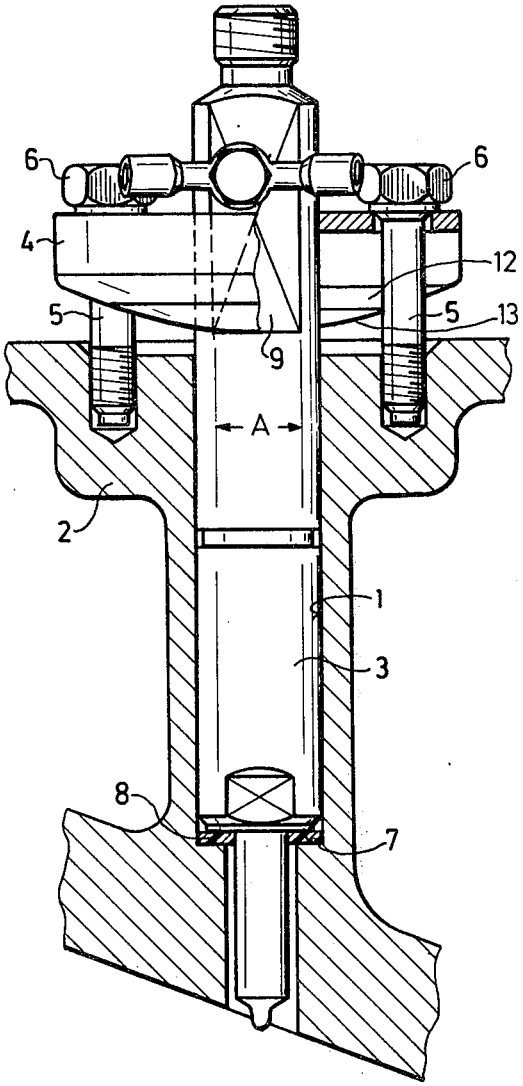
FIG. 1 is a longitudinal, partially sectional view of a cylinder head portion illustrating a fuel injection nozzle in assembly with a clamping device according to the present invention.

Referring now to FIG. 1, in the bore 1 of an only partly and sectionally shown engine cylinder head 2, there is disposed a fuel injection nozzle 3 clamped against a sealing seat 7 by a bracket 4 (the clamping device) with the aid of bolts 5 and nuts 6. Between the sealing seat 7 and the corresponding shoulders of the injection nozzle 3 there is disposed a sealing ring 8. The end of the injection nozzle farthest from the engine cylinder exhibits the flattened portions 9, which form shoulders 10 on which the bracket 4 is supported.

Figure 2:
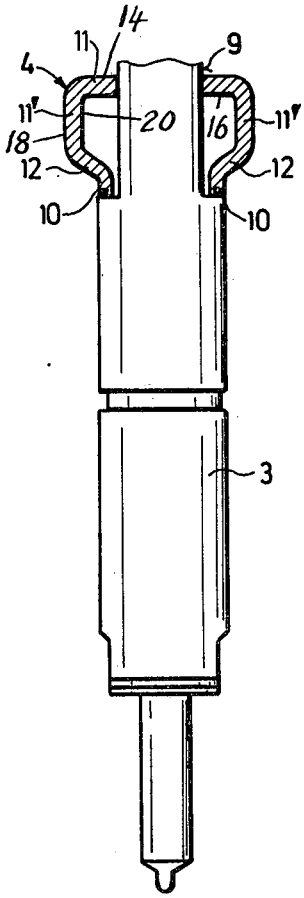
FIG. 2 is a side elevational view of the nozzle in assembly with the clamping device rotated 90° with respect to the view illustrated in FIG. 1.
Figure 3:
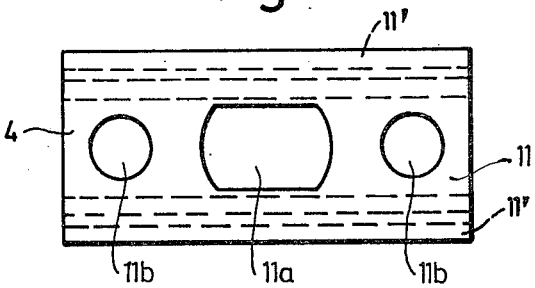
FIG. 3 is a top plan view of the clamping device as seen from the engine.

The bracket 4 has a U-shaped cross section including a generally flat top portion 11 from which free legs 11′ extend. The legs 11′ are supported on the shoulders 10 of the injection nozzle. The top portion 11 has substantially parallel top and bottom surfaces 14 and 16, while the legs 11′ have substantially parallel side surfaces 18 and 20 which are perpendicular to the top and bottom surfaces 14 and 16. The free legs 11′ are substantially parallel, but in a preferred embodiment, shown in FIG. 2, are offset at the location 12 which prevents legs 11′ from buckling laterally during a high bending load on the bracket. The top portion 11 has preferably a slot 11*a* formed generally at its central part and openings 11*a* and 11*b*. The slot 11*a* is adapted to accommodate the flattened portions 9 (FIG. 2), while the openings 11*a* and 11*b* are adapted to each accommodate a bolt 5 (FIG. 1).

The offset 12 also makes it possible for the bracket to be more elastic than a pure U-profile would be.

The lower edges of the legs, as shown in FIG. 1, are curved generally convexly at 13, resulting in a well-defined bearing location A on the shoulder of the nozzle and providing a relief which increases toward the ends of the bracket.

Location 12 is normally offset by 45° in relation to the valve axis. The radii between legs 11′ and location 12 up to shoulder 10 may, however, be such (4 mm) that they interconnect. There is a large radius at 13 (e.g. R 75 mm) to enable a minor tilting of brackets 4 whereby a uniform distribution of the fastening forces by the bolts is obtained. The radius may end in a straight line towards the outside which are inclined by approx. 15° in relation to the horizontal. For rigidity reasons the end of the radius of a straight line lies below the connection from legs 11′ to location 12.

What is claimed is:

1. In combination, an injection nozzle, a cylinder head of an internal combustion engine, a clamping device in the form of a bracket for use in clamping the fuel injection nozzle to the cylinder head, and fastening means for fastening opposite, longitudinally extending top end sections of the clamping device to the cylinder head, said clamping device comprising:

(a) a generally flat top portion having substantially parallel top and bottom surfaces, defining a centrally disposed slot formed therein for receiving therethrough a portion of the injection nozzle, and including said opposite longitudinally extending end sections adapted for use with the fastening means; and (b) two parallel leg portions extending from opposite sides of said top portion each having substantially parallel side surfaces perpendicular to the top and bottom surfaces of said top portion, said leg portions and said top portion defining, throughout their longitudinal extent, a U-shaped cross-sectional profile with the free end of each of said legs defining a bearing surface which faces the cylinder head, said legs being adapted, when said device is assembled with the injection nozzle and means fastening said clamping device to the cylinder head, to bear against a respective flattened portion on the injection nozzle.

2. The combination as defined in claim 1, wherein the bearing surfaces are curved generally convexly in their longitudinal extent.

3. In combination, an injection nozzle, a cylinder head of an internal combustion engine and fastening means, and a clamping device in the form of a bracket for use in clamping the fuel injection nozzle to the cylinder head, said clamping device comprising:

(a) a generally flat top portion having a slot formed therein for receiving therethrough a portion of the injection nozzle; and (b) two leg portions extending from said top portion, said leg portions and said top portion defining a U-shaped cross-sectional profile with the free end of each of said legs being adapted when said device is assembled with the injection nozzle and means fastening said clamping device to the cylinder head, to bear against a respective flattened portion on the injection nozzle, wherein said leg portions are directed parallel to each other and wherein said leg portions each include an offset region at its free end such that the distance between said leg portions is a minimum at the offset regions.

* * * * *